United States Patent [19]

Krings

[11] 3,937,026

[45] Feb. 10, 1976

[54] LINING APPARATUS FOR THE PROTECTION OF TRENCHES

[76] Inventor: Josef Krings, Hans-Boeckler-Str. 23, D 5138 Heinsberg, Oberbruch, Germany

[22] Filed: Sept. 24, 1974

[21] Appl. No.: 508,829

[30] Foreign Application Priority Data

Oct. 4, 1973 Germany ..... 2349802

[52] U.S. Cl. ..... 61/41 A; 61/63

[51] Int. Cl.[2] ..... E21D 5/12

[58] Field of Search ..... 61/41, 41 A, 45, 63; 52/479, 495

[56] References Cited

UNITED STATES PATENTS

| | | | |
|---|---|---|---|
| 841,773 | 1/1907 | Fitzgerald | 61/41 A |
| 1,079,113 | 11/1913 | Conzelman | 61/4 UX |
| 3,555,830 | 1/1971 | York | 61/41 A |
| 3,593,528 | 7/1971 | Pavese | 61/41 A |

*Primary Examiner*—Dennis L. Taylor

*Attorney, Agent, or Firm*—Diller, Brown, Ramik & Wight

[57] ABSTRACT

This disclosure relates to a lining apparatus for the protection of trenches, which lining apparatus includes lining plates which are insertable in pairs in vertical sliding carriers on the side of the trench and are capable of being pressed against the wall of the trench by expanding devices, each lining plate including two component plates connected together loosely and detachably and the component plates being guided together in the sliding carriers with the outer dimension of the component plates being approximately equal to those of a unitary lining plate.

6 Claims, 5 Drawing Figures

LINING APPARATUS FOR THE PROTECTION OF TRENCHES

This invention relates to lining apparatus for the protection of trenches for utilities such as pipes and cables; consisting of lining plates which can be inserted in pairs in vertical sliding carriers on the edge of the trench, the plates being capable of being pressed by adjustable expanding devices against the wall of the trench.

The dismantling of the lining apparatus forms a substantial part of the work entailed in lining the trench, i.e. The extraction and taking apart of the lining plates and sliding carriers, after or during the filling of the trench. As the lining apparatus have to be reused many times, they must be handled with appropriate care. In order to avoid accidents, the lining plates must not be extracted until there is sufficient certainty that the walls of the trench will not collapse. This in turn presupposes a sufficient consolidated filling of the trench.

The lining plates are of course, during extraction, subjected to considerable frictional forces so that extracting devices of considerable strength are required. Since the gripping locations for the extracting devices on the lining plates are subject to a considerable tension load, it is desirable to lighten the extraction work and substantially reduce the traction forces which need to be applied to the plates.

An object of this invention is to provide lining apparatus such that it permits comparatively light dismantling work.

According to the invention there is provided a lining apparatus for the protection of trenches, comprising lining plates which are insertable in pairs in vertical sliding carriers on the side of the trench, and capable of being pressed against the walls of the trench by expanding devices, wherein each lining plate consists of two component plates connected together loosely and detachably, the component plates being guided together in sliding carriers, and the outer dimensions of the component plates being approximately equal to those of a unitary lining plate.

The construction according to the invention has the advantage that the component plate, which upon being driven into the soil is worn the most, can be replaced more cheaply that if, as previously, a complete lining plate has to be exchanged.

In order to be certain that the lining plate, consisting of two component plates is inserted uniformly into the ground, according to a preferred construction of the invention, it is advantageous of one of the two component plates engages under the other plate by means of a bracket. By this means it is ensured that the component plates can then be moved relative to one another only upon extraction, and not during pressing into the ground. At the same time there is thus obviated any need for screws which are sheer-resistant, which would be needed to connect the component plates detachably to each other. In addition, it is possible to place two lining plates on top of one another in a simple manner if it is required to protect particularly deep trenches.

In order to render possible easy use of the lining plate, it is advantageously arranged that one of the two component plates is connected to a pointed plate foot part. This plate foot part may be connected firmly or detachably to one of the component plates or to a bracket.

In order to reduce to a minimum frictional forces between the two component plates, there are advantageously friction reducing means disposed between the two component plates.

The friction reducing means may consist of perpendicular sliding bars connected to at least one of the component plates. Both component plates are advantageously connected to sliding bars which are disposed to slide on one another.

It is furthermore of advantage it at least the sliding faces of one component plate has a plastics coating.

The invention will be further described by way of example, with reference to the accompanying drawings, wherein.

Figure 1:
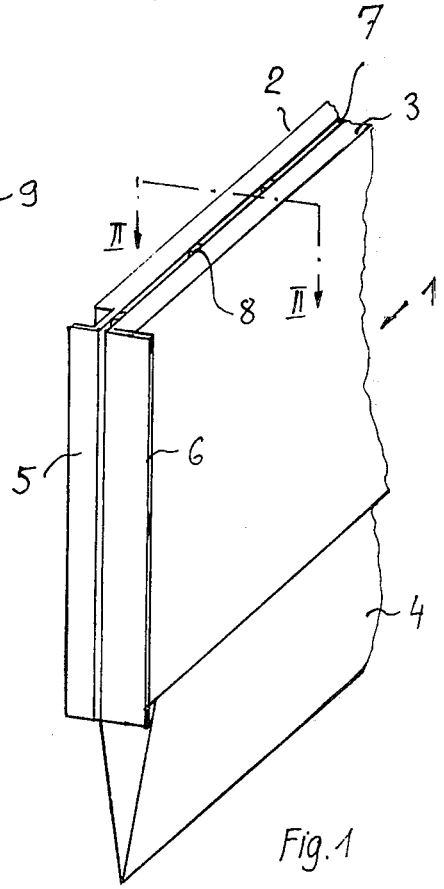
FIG. 1 is a partial perspective view of a lining plate according to the invention.

FIG. 1 shows in perspective the front part of a lining plate 1 which is formed as a so-called edge supporting plate. This lining plate 1 consists of two component plates 2, 3, perpendicularly super-imposed, and a foot plate part 4 placed on the component plate 2. The end of the lining plate 1 consists of flanges 5 and 6 which are attached to the component plates 2 and 3 respectively, and are guided in a perpendicular sliding carrier (not shown). Between the component plates 2, 3 there is arranged a gap 7 in which are disposed some perpendicular guide bars 8 which are firmly connected to one of the component plates 2 or 3 respectively. By means of these guide bars the faces of the two single plates 2 and 3 moveable on one another are reduced to a minimum.

Figure 2:
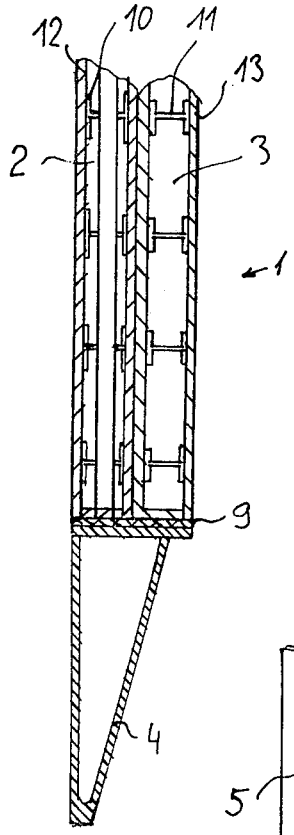
FIG. 2 is a perpendicular longitudinal sectional view on line II — II of FIG. 1.

FIG. 2 shows a lining plate similar to that of FIG. 1 in a perpendicular longitudinal section, and with this plate, no gap 7 is arranged between the component plates 2 and 3, nor are there guide bars 8. The drawing shows that the outer component plate 2 (that is, the component plate which is placed directly at the top of the trench) is at its lower end received in a plate 9 which also acts at the same time as a support bracket for the component plate 3. By means of this plate 9 it is possible to introduce the two component plates together and without material movement into the ground.

Each component plate consists in known manner of a frame formed from profiled supports 10 and 11 respectively, and cover plates 12 and 13 respectively fixed theron. Other types of lining plate are also feasible within the scope of the invention.

Figure 3:
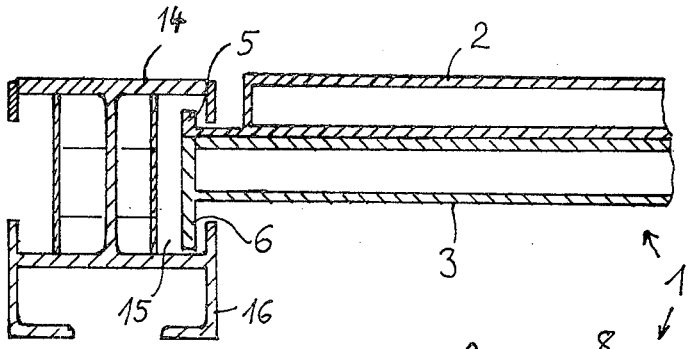
FIGS. 3 to 5 are horizontal sectional views of different embodiments of lining plates which are guided in perpendicular sliding carriers.

A lining plate according to FIG. 2 is shown in horizontal cross-section in FIG. 3. The flanges 5, 6 and guided to lock in a generally T-sectioned channel 15 is in a perpendicularly sliding carrier 14 which has directed towards the inside of the trench, a likewise slotted hollow cross-section strip 16 to receive shors on expanding devices for forcing the lining plates against the trench wall.

Figure 4:
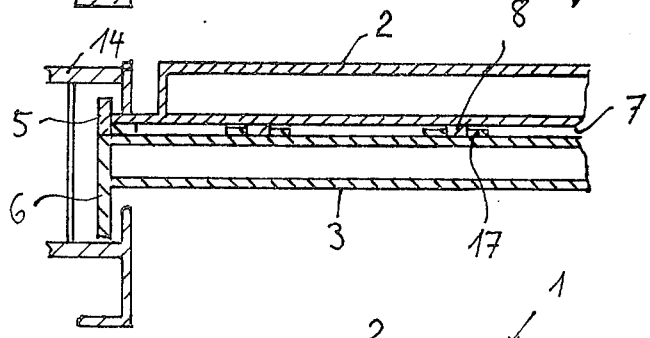

FIG. 4 shows a modified construction of a lining plate. Herein, a gap 7 as in the plate of FIG. 1 is provided and there are sliding bars 8 provided and fixed to the component plate 2. On both side of the sliding bars 8 guide bars 17 are fixed on the component plate 3 so that the two component plates 2 and 3 are guided and interlock in the perpendicular direction.

Figure 5:
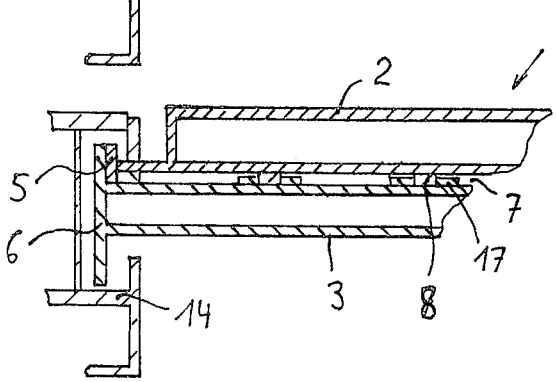

The lining plate according to FIG. 5 differs from that of FIG. 4 in that the flange 6 of the inner component plate 3 engaged around the flange 5 of the component plate 2. This construction could be of course reversed so that the flange 5 engages around the flange 6.

In practical use, first of all the inner component plate 3 is extracted, and is guided by sliding over the component plate 2 being subjected only to the frictional forces of the filling in the trench. After this component plate 3 has been extracted, there is no longer any difficulty in extracting the component plate 2 remaining in the lining.

In order to bring about further reduction in the frictional forces between the two component plates, 2, 3, it may be expedient for a plastic coating to be provided on at least one of the sliding faces of the two component plates. A plastics coating may also be provided on the outer walls of the component plates 2, 3.

I claim:

1. Lining apparatus for the protection of trenches comprising vertical sliding carriers and lining plates which are insertable in pairs in said vertical sliding carriers on the side of a trench and capable of being pressed against walls of a trench by expanding devices, each said lining plate comprising two component plates assembled together loosely and detachably, said component plates being guided together in said sliding carriers, and one of said component plates has a bracket along its lower edge which engages under the lower edge of the other of said plates to generally maintain a vertically adjacent relationship between said two component plates.

2. Lining apparatus according to claim 1 wherein a pointed plate foot part forms an extension of said component plates and is connected to said bracket with a lower edge of other of said component plates being seatable thereon.

3. Lining apparatus according to claim 1 wherein friction reducing means are disposed between said component plates.

4. Lining apparatus according claim 3 wherein said friction reducing means comprise perpendicular sliding bars connected to at least one of said component plates.

5. Lining apparatus according to claim 4 wherein both said component plates are connected to respective ones of said sliding bars, and there are guide bars respectively guided in one another and connected to said component plates.

6. Lining apparatus according to claim 3 wherein said friction reducing means is in the form of at least that face of at least one of said component plates facing the other of said component plate being coated with a plastics material.

* * * * *